US006041613A

United States Patent [19]

Morse et al.

[11] Patent Number: 6,041,613

[45] Date of Patent: Mar. 28, 2000

[54] ENERGY CONSERVING HEAT PUMP SYSTEM

[76] Inventors: Cecil O. Morse, 495 Karen Dr., Prescott, Ariz. 86303; Harold S. Nutt, 422 N. Arizona St., Prescott, Ariz. 86301

[21] Appl. No.: 08/270,742

[22] Filed: Jul. 5, 1994

[51] Int. Cl.[7] ..... F28D 5/00

[52] U.S. Cl. ..... 62/305; 62/238.7

[58] Field of Search ..... 62/305, 238.6, 62/238.7, 279

[56] References Cited

U.S. PATENT DOCUMENTS

| | | | |
|---|---|---|---|
| 3,916,638 | 11/1975 | Schmidt | 62/238.6 |
| 3,922,876 | 12/1975 | Wetherington | 62/180 |
| 4,041,726 | 8/1977 | Mueller et al. | 62/238.6 |
| 4,091,636 | 5/1978 | Margen | 62/238.6 |
| 4,285,392 | 8/1981 | Rannow | 165/50 |
| 4,448,244 | 5/1984 | Demuth et al. | 165/141 |
| 4,514,990 | 5/1985 | Sulkowski | 62/238.7 |
| 4,529,033 | 7/1985 | Blum | 165/39 |
| 4,538,418 | 9/1985 | Lawrence et al. | 62/79 |
| 4,572,429 | 2/1986 | Huffman et al. | 237/2 B |
| 4,676,071 | 6/1987 | Latimer | 62/225 |
| 4,718,248 | 1/1988 | Fisher | 62/238.7 |
| 5,003,788 | 4/1991 | Fischer | 62/238.7 |

FOREIGN PATENT DOCUMENTS

| | | | |
|---|---|---|---|
| 2633100 | 2/1978 | Germany | 62/238.6 |
| 237313 | 8/1945 | Switzerland | 62/238.6 |

*Primary Examiner*—William Doerrler
*Attorney, Agent, or Firm*—Gregory J. Nelson

[57] ABSTRACT

A cooling system of the type having a cooler section. The conventional cooling tower is disconnected and replaced by a cooling loop connected to a water source such as a municipal water supply, irrigation system or gray water system which cools the condenser portion of the cooler. Isolating heat exchangers may be interposed in the cooling loop to avoid contamination. A by-pass system and tempering valve maintain the water supply at a predetermined temperature. Heat may be extracted from the water return and utilized at a remote location as for heating a part of a building while another part is being cooled.

7 Claims, 5 Drawing Sheets

ENERGY CONSERVING HEAT PUMP SYSTEM

BACKGROUND OF THE INVENTION

1. Field of the Invention

The present invention relates to an air conditioning system which reduces energy consumption by disposing of waste heat to a low temperature heat sink. More particularly, the present invention relates to a system which utilizes existing municipal water supplies or effluent as a water supply for absorption or rejection of heat.

2. Description of the Prior Art

Many residential and commercial air conditioning systems employ conventional heat pumps. Such conventional heat pump systems operate on a closed vapor compression/expansion cycle with heat being rejected to ambient air. Systems of this type include an evaporator with a refrigerant expansion valve, heat exchangers, a directional control valve and suitable fans and auxiliary components. In the conventional heat pump system, the heat exchangers are alternately operated as evaporators and condensers to achieve heating or cooling depending upon the position of the directional control valve in the interconnecting fluid conduit. One heat exchanger unit, the indoor unit, has associated apparatus such as a fan. The other heat exchanger, the outdoor unit, is operated to either add heat to the system or remove heat from the system.

Water source heat pumps (WSHP) are a specialized type of heat pump which are reverse cycle units that use water as a heat source when in the heating mode and as a heat sink in the cooling mode. Thus, heat is absorbed or rejected in a fluid medium rather than in ambient air. Water loop heat pumps (WLHP) use a circulating water loop. When the loop water temperatures exceed a certain level due to the heat added as a result of the heat pump cooling, a device such as a cooling tower dissipates heat from the water loop to the atmosphere. When the water loop temperature drops below a prescribed level due to heat being removed as a result of heating of ambient air at the indoor unit, heat is added to the circulating loop water usually through an auxiliary component such as a boiler.

The water supply may be a recirculating closed loop, well lake or a stream. Reference is also made to the ASRAE 1988 *Equipment Handbook*, Chapter 43. Various patents can be found in the prior art dealing with water source heat pumps.

U.S. Pat. No. 4,238,933 shows an air conditioning system which reduces energy consumption by disposing of waste heat to a low temperature heat sink and at the same time recovers usable energy. An auxiliary liquid cooled condenser is connected in parallel with the air condenser of a conventional vapor compression air conditioning system across a valve located between the compressor of the existing system and the condensers. When the valve is actuated, the refrigerant of the air conditioning system is directed from the air conditioner, through the liquid cool condenser assembly in heat exchange relationship with the body of fluid which is at lower temperature than ambient air such as water from a swimming pool or from a municipal water supply. Energy conservation is achieved by use of the total heat content of the refrigerant rather than only the high temperature heat as in prior art sources.

U.S. Pat. No. 4,538,418 discloses a water source heat pump system having a fluid refrigerant compressor. The heat pump system further includes first and second heat exchanger units. Suitable fluid conduits interconnect the fluid refrigerant compressor and the heat exchange units in series relationship. A pre-heat exchanger is connected between the water source and the heat exchangers which control the water temperature to the second heat exchanger. In the cooling mode, the water supply will bypass the pre-heat exchanger. Flow control valves are interconnected between the water source and the second heat exchanger unit for controlling the amount of water flowing from the water source to the second heat exchanger. The flow control valves are responsive to the pressure at the outlet of the fluid refrigerant compressor to automatically optimize the operating conditions of the heat pump. The water source may comprise a well, stream or body of water such as an ocean or lake. The water source may also comprise a closed system such as an above-ground or underground water storage tank or underground pipe loop system.

As mentioned above, it is well known in the art that the energy consumption of an air conditioning system may be reduced by use of a low temperature heat sink while at the same time recovering the rejected heat for possible other applications. Other systems which utilize sources such as swimming pool water as a heat sink are shown in U.S. Pat. Nos. 4,019,338; 3,976,123 and 3,926,008.

While the above systems are effective, they differ from the present invention in a number of important aspects, particularly with respect to their application as retrofit systems to existing installations. The present invention relates to a system that is cost-effective as a retrofit to existing air conditioning installations, particularly commercial installations. With the present invention, existing cooling towers which are conventionally used to cool the water loop and which are highly maintenance intensive and have an operational lifetime of only 10 to 20 years, are eliminated. The elimination of the cooling tower not only eliminates the cost of maintenance of a cooling tower but also eliminates the substantial water loss that occurs through use of cooling towers. For example, cooling tower for an air conditioning system for a 40 story, 800,000 square foot building, will utilize about 150,000 gallons of water per day, about one-half of which is discharged to waste or lost through evaporization.

It is also within the scope of the present invention to provide a system which replaces the exterior compressor and condensing coil components of air-to-air split systems common in smaller installations where it is not economical to install water cooling tower systems. In the modified system, a potable water loop is provided to each unit from municipal water supply or other water source. Such a system is more efficient than conventional air-to-air systems and requires only a minimum of modification.

SUMMARY OF THE INVENTION

Briefly, in accordance with the present invention, a modified liquid chilling system operating on refrigeration cycle having a compressor, refrigerant circuit, water-cooled condenser is provided. In the conventional system, condenser water leaves the cooling tower at about 85° F. and enters the condenser cooling unit and returns to the cooling tower. In the modification according to the invention, the cooling tower is eliminated and the liquid chilling system is a refrigeration system having a water source heat pump which operates on a reverse cycle. In the cooling mode, the heat exchanger unit, operating as a condenser, is directly or indirectly connected through a water loop to a water source such as a municipal water supply or effluent of a suitable temperature such as gray water or industrial waste water.

One or more intermediate isolating heat exchangers may be interposed in the water loop. The water pump heat source is preferably a unit which can be located on the roof of the building or in a suitable basement or equipment room which would be in many cases more convenient for connection to the water source.

In a modification of the present invention, water at a suitable temperature as for example 85° is directly connected to a noncontaminating chiller. The chiller cools the working fluid which is circulated to the fan coil unit. The incoming water from the municipal water supply or other source may be tempered by mixing valves with the warmer fluid discharged from the chillers to temper the supply to predetermined temperature. Heat may also be extracted from the water discharged from the chiller in a heat pump or heat exchanger for transfer to boilers or other applications.

BRIEF DESCRIPTION OF THE DRAWINGS

The above and other objects and advantages of the present invention will become more apparent from the following description, claims and drawings in which:

DESCRIPTION OF THE PREFERRED EMBODIMENTS

Figure 1:
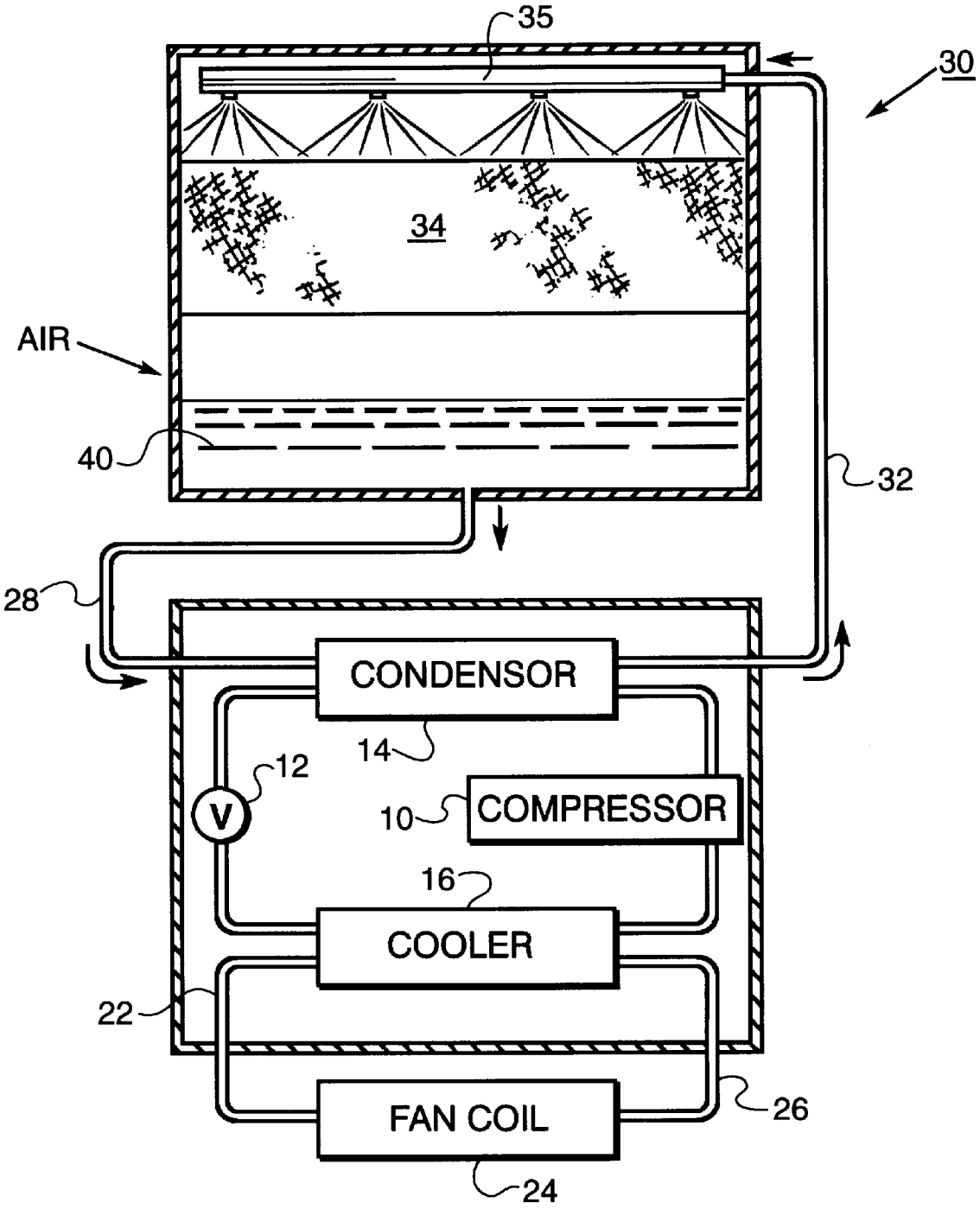
FIG. 1. (PRIOR ART)
FIG. 1 is a schematic diagram of a conventional prior art chiller unit utilizing a cooling tower.

Turning now to the drawings, a schematic diagram of a conventional chiller system is shown in FIG. 1 and is labeled as being representative of the prior art. The prior art chiller system includes a refrigeration system having a compressor 10, expansion valve 12, condenser 14 and a cooler 16. The compressor compresses a volume of refrigerant such as halocarbon gas. Reduction of the volume of the refrigerant increases the temperature of the gas. On the high pressure side, the refrigerant is directed through a water cooled condenser 14 from where it is directed across an expansion valve 12 to cooler 16. Chilled water leaves the cooler 16 at line 22 and is directed to a fan coil unit 24 which supplies cool air to a temperature-controlled space or area. Return water is directed to the cooler from the fan coil unit at conduit 26. Typically, chilled water leaves the cooler at approximately 44° F. and returns at about 54° F.

Condenser cooling water is provided to the condenser via line 28 from cooling tower 30. Typically, the water from the cooling tower is about 85° F. Water exits the condenser 14 at approximately 95° and is directed to the cooling tower via line 32. The cooling tower may be of various types such as a direct contact device or an indirect contact evaporative cooling tower. For purposes of representation, cooling tower 30 is shown as a direct contact type having a distributor 35 at the upper end of a housing 30. Water is sprayed downwardly and passes through a fill or packing 34 transferring the source heat load directly to the air which is warmed and exits from the top of the cooling tower. Cooled water collects in a sump 40 at the bottom and, as has been discussed, is directed to the condenser to cool the condenser by line 28.

Systems such as shown in FIG. 1 are widely used and are generally effective. However, providing condenser cooled water by means of a cooling tower is both expensive and wasteful. Cooling towers are very maintenance intensive due to the environment in which they operate. Often, the effective life of a cooling tower is only 10 years. Also, a cooling tower for a 40-story, 800,000 square foot building will require approximately 150,000 gallons of water per day, about one-half of which is directed to waste or lost to evaporization.

Thus, with the present invention, the cooling tower system as shown in FIG. 1 is replaced with a water source heat pump using a municipal water distribution system as the heat sink or heat source.

Figure 2:
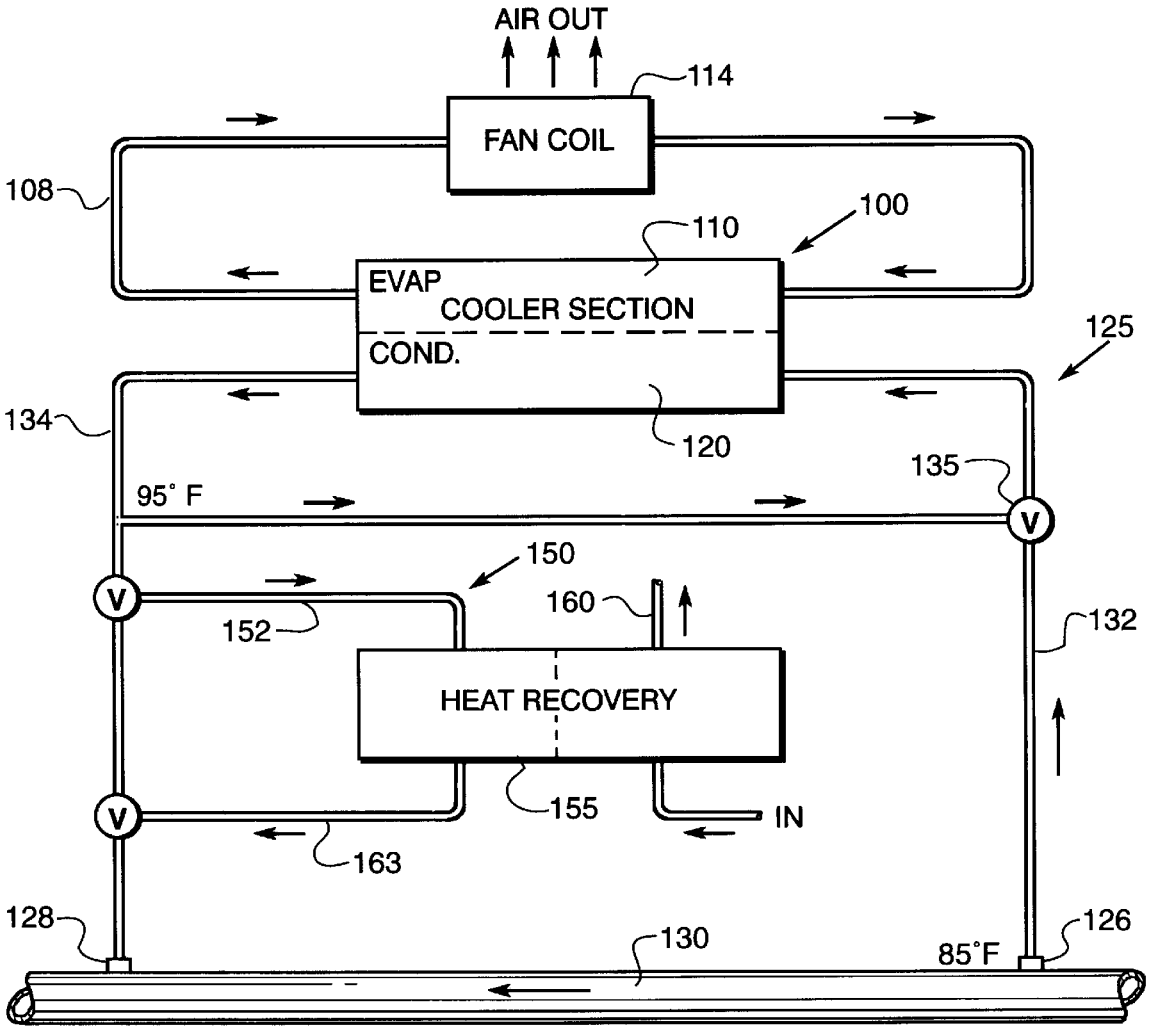
FIG. 2 is a schematic diagram of another embodiment of the present invention showing direct connection and circulation of water from a municipal supply to the chiller/condenser heat exchanger and including provision for tempering the incoming water and extracting heat from the return water.

FIG. 2 shows a modified form of the water source heat pump 100 which is shown as a single package reverse cycle unit. In the normal cooling mode, the unit has a cooler/evaporative section 110 through which refrigerant flows to cause the refrigerant to evaporate extracting heat from the water passing through the chiller. The water exits the cooler at conduit 108 and is directed to a fan coil unit 114 which supplies cool air to a controlled space. Return water flows from the fan coil to the chiller via line 112.

The condenser side of the heat pump 100 is designated by the numeral 120. Condenser cooling water is again supplied in a water loop 125 which is connected at tap 126 to municipal water main 130. Conduit 132 extends between the tap 126 and the condenser 120. Typically, the condenser cooling water enters the condenser at approximately 85° F. and exits at line 134 at approximately 95° F. The conduit 134 connects the condenser with the municipal water line 130 at connection 128 downstream of tap 126. A mixing valve 135 is thermostatically controlled and is interposed in the conduit 132. Mixing valve 135 connects with conduit 134 via conduit 142. As indicated above, the potable water from most sources such as water mains generally would be about 85° F. If the temperature of the water introduced into the chiller condenser varies significantly from the predetermined set point, the temperature of the water entering the chiller can be tempered by mixing it with the warmer water exiting the chiller. The warmer water flows through conduit 134, conduit 142 into mixing valve 135 where it is mixed with the colder water from the water loop which is warmed and introduced into the chiller via line 125.

It is also possible to extract heat from the warm water exiting the chiller through line 134. To this end, a heat recovery loop 150 is provided. Heat recovery loop 150 includes a conduit 152 which diverts a portion of the water exiting the condenser to heat recovery unit 155 by means of valve 156. The heat recovery system 155 may be a simple liquid-to-liquid heat exchanger in which the heated liquid is directed by line 160 to a boiler or other point of use. The heat recovery unit 155 may also be a heat exchanger with the warmed fluid being utilized as a heat source. Heat extraction will result in the water returning from the heat recovery unit to be cooled and returned via conduit 163 across valve 162 to connection 128 where it is returned to the city water supply. The heat extraction system would be particularly useful during certain seasons when buildings, due to their orientation or location, may require simultaneous heating and cooling in different zones or areas of the building. Heat extraction would also be applicable to certain applications as hospitals where the extracted heat may economically be used for other uses such as heating water. Thus, the fan coil unit 114 can be used to generate cold air for cooling zones and the heat extraction system 150 can be used to provide heat to those areas requiring heating.

Figure 2A:
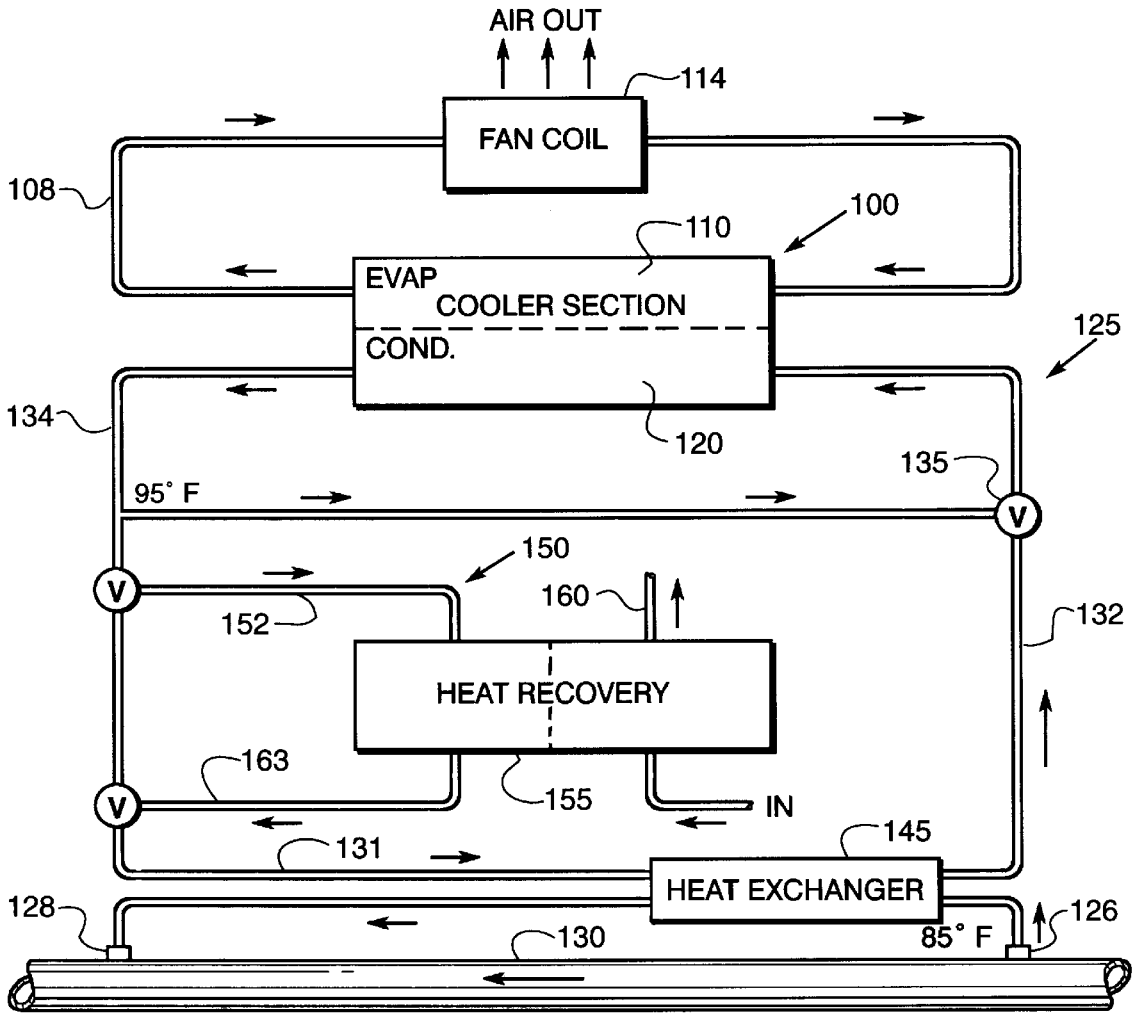
FIG. 2A is a schematic diagram of a system similar to that shown in FIG. 2 with the addition of an isolating heat exchanger to protect the potability of the municipal supply water.

FIG. 2A shows a system essentially identical to that shown in FIG. 2. Accordingly, the same numerals have been used to identify common components and repetitive description of these common components is not believed necessary. The embodiment of FIG. 2A includes a heat exchanger 145 which receives water from the municipal supply 130 and returns it to the supply at 128 to maintain the potability of the supply. A working fluid is cooled in the heat exchanger and directed to cooler 120 via conduit 132. The heated working fluid is returned to the heat exchanger by means of conduit 131.

Figure 3:
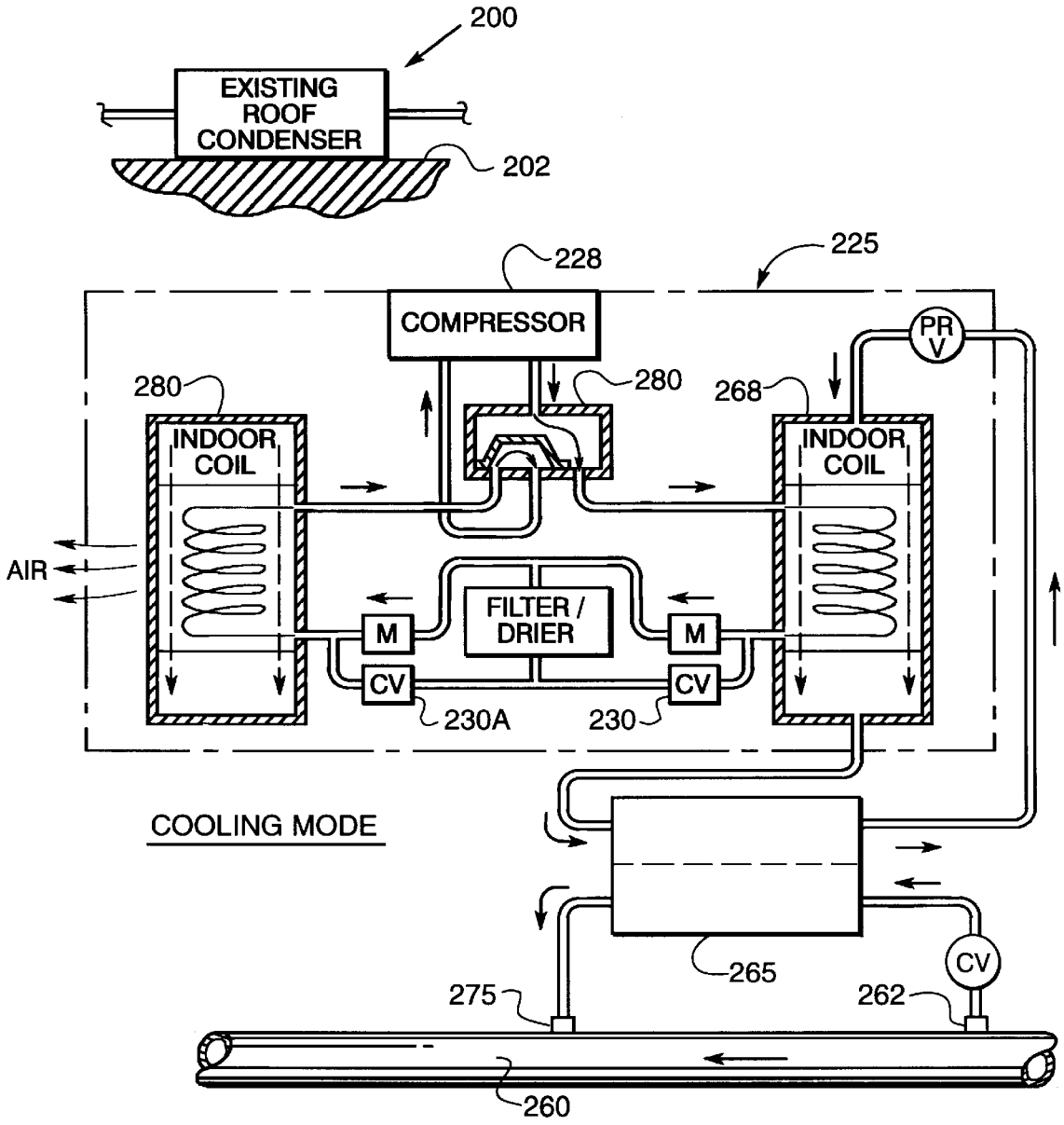
FIG. 3 is a schematic diagram of an alternate embodiment of the present invention in which the outdoor compressor/condenser coil in an air-to-air split system is replaced with a water source heat pump communicating with a potable water source shown in the cooling mode.
Figure 4:
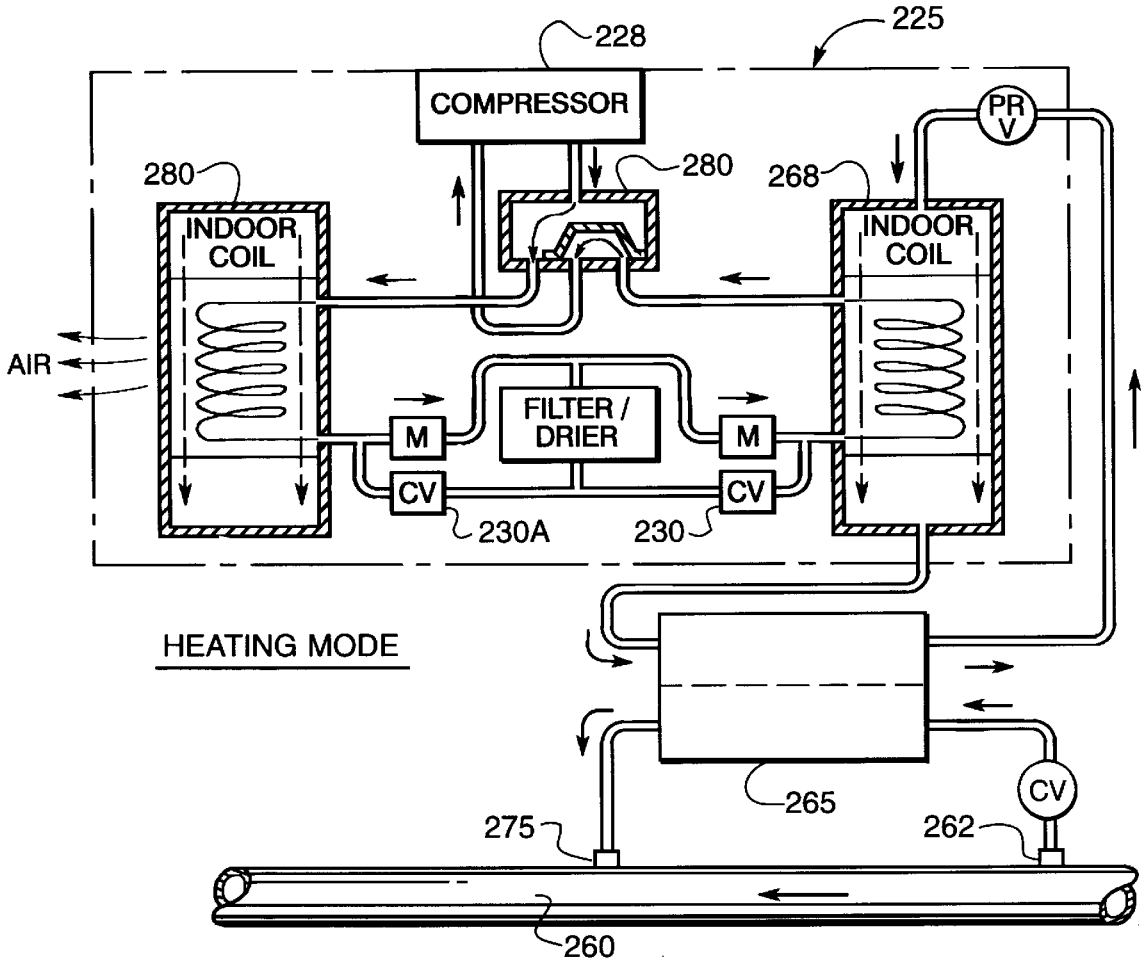
FIG. 4 is a diagram similar to FIG. 3 showing the water source heat pump operating in the heating mode with heat being absorbed from a water source shown as a municipal main.

FIGS. 3 and 4 illustrate another embodiment of the present invention in which the outside compressor and condensing coil on conventional air-to-air split systems are replaced with water source heat pumps. As shown in FIG. 4, many smaller commercial heating and air conditioning systems will place a condenser and compressor unit 200 on the roof of a building 202. Such systems rely on cooling the condensing coil by air-to-air heat exchange as chilled water cooling tower systems are not economical for such installations.

With the present invention, the existing roof mounted condenser is disconnected and replaced with a water source heat pump 225 at a suitable, convenient location. The water source heat pump may be located on the roof but it would be more efficient to mount the unit in a basement or equipment room of the building. In such instance, the water source heat pump would be more convenient to a source of water such as a municipal water supply flowing through the city water main 260. Water supplied to the water source heat exchanger from a water main 260 at connection 262. The water is directed to an isolating heat exchanger 265 is interposed in the water loop system. Water from the water main is circulated through the isolating heat exchanger 265 in indirect contact with the cooling water in the cooling water loop which circulates through the heat exchanger 268 to cool the condenser coils when operating in the cooling mode. The water supply to the isolating heat exchanger is returned at a slightly elevated temperature to the water main 260 at connection 275.

The water source heat pump 225, as has been described above, operates in the cooling mode and the compressed refrigerant from compressor 228 is directed by the reversing valve 280 to the heat exchanger 268. Heat exchanger 268 functions as a condenser and the refrigerant gives up heat to the water circulating from the heat exchanger 268 to the isolating heat exchanger 265 and thereby becomes a liquid at high pressure. The refrigerant flows across a thermostatic expansion valve 230 in which the compressed refrigerant is expanded. With the reduction of pressure, the refrigerant passes from the liquid state to a gaseous state and enters the second heat exchanger or the indoor coil 280. The indoor coil 280 serves as an evaporator to remove heat from air passing over the coils of the heat exchanger thereby cooling the air. The cooled air is directed to the temperature controlled space.

In the heating mode of operation shown in FIG. 4, the reversing valve 280 has been shifted to a position such that the indoor coil 280 serves as a condenser and the heat exchanger 268 serves as an evaporator. In this mode of operation, the secondary cooling loop provides heat. The primary cooling loop consists of water from the municipal water main extracted at tap 262 and circulated through a section of the intermediate or isolating heat exchanger 265. The relatively warmer water will heat the refrigerant in heat exchanger 268 which heat is given off at coil 280.

While the foregoing water source heat pump system has been described with reference to use of municipal water main or water supply system as the water source, other suitable water sources may be used such as gray water or industrial waste fluid which has suitable temperature and other characteristics. In such instances, an isolating or intermediate heat exchanger will necessarily be interposed so that the water loop consists of a primary loop and a secondary loop thereby substantially reducing the possibility of contamination of the condenser. Also, because of regulations relating to the use and discharge of municipal water supplies and concern about contamination, one or more intermediate or isolating heat exchangers will normally also be provided in the water loop.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

We claim:

1. A method of retrofitting a chiller system of the type having a condenser, cooler, compressor interconnected and operating on a vapor compression cycle and in which cooling water is supplied to the condenser and returned to a cooling tower, said method comprising:

(a) disconnecting the cooling water supply to the condenser from said cooling tower; and (b) re-connecting said condenser to a cooling water supply from an existing in-place water supply dedicated for another use whereby cooling water is supplied to the condenser and returned to the water supply.

2. The method of claim 1 wherein said water supply is a municipal water supply.

3. The method of claim 1 wherein said water supply is an irrigation system.

4. The method of claim 1 wherein said water supply is a gray water source.

5. The method of claim 1 further including the step of providing an isolating heat exchanger interposed between said condenser and said water supply.

6. The method of claim 1 wherein said condenser, cooler and compressor are located in an equipment area convenient to the existing in-place water.

7. The method of claim 1 further includes a temporary valve interconnected between the cooling water and the water returned to maintain the cooling water at a predetermined temperature.

* * * * *